United States Patent [19]

Someya et al.

[11] Patent Number: 4,974,837

[45] Date of Patent: Dec. 4, 1990

[54] WEIGHT TRAINING MACHINE

[75] Inventors: Fumio Someya; Kenichi Takahashi, both of Tokyo, Japan

[73] Assignee: Senoh Kabushiki Kaisha, Tokyo, Japan

[21] Appl. No.: 361,293

[22] Filed: Jun. 5, 1989

[30] Foreign Application Priority Data

Jul. 15, 1988 [JP] Japan ..... 63-93807[U]

[51] Int. Cl.[5] ..... A63B 21/062

[52] U.S. Cl. ..... 272/118; 272/130

[58] Field of Search ..... 272/117, 118, 130, 134

[56] References Cited

U.S. PATENT DOCUMENTS

| | | | |
|---|---|---|---|
| 3,635,472 | 1/1972 | Marcyan | 272/118 |
| 3,708,166 | 1/1973 | Annas | 272/134 |
| 3,815,903 | 6/1974 | Blomqvist | 272/118 |
| 3,840,227 | 10/1974 | Chesemore | 272/118 |
| 3,912,261 | 10/1975 | Lambert, Sr. | 272/118 |
| 3,912,263 | 10/1975 | Yatso | 272/118 |
| 4,111,414 | 9/1978 | Roberts | 272/118 X |
| 4,188,029 | 2/1980 | Brower et al. | 272/118 X |
| 4,509,745 | 4/1985 | Angsten | 272/130 |
| 4,546,971 | 10/1985 | Raasoch | 272/134 X |
| 4,621,307 | 11/1986 | Stramer | 272/118 X |
| 4,666,151 | 5/1987 | Chillier | 272/118 X |
| 4,848,738 | 7/1989 | Mueller | 272/118 |

FOREIGN PATENT DOCUMENTS

| | | | |
|---|---|---|---|
| 0177643 | 4/1986 | European Pat. Off. | 272/118 |
| 1389789 | 4/1988 | U.S.S.R. | 272/118 |

*Primary Examiner*—Robert Bahr

*Attorney, Agent, or Firm*—Bachman & LaPointe

[57] ABSTRACT

A noiseless weight training machine is provided. The machine comprises a base frame mounted on a floor, a rectangular weight frame installed on the base frame, a pair of parallel guiding rods extending vertically from the base frame, a plurality of weight blocks for traveling up and down along the guide rods, a weight block connecting unit for connecting weight blocks of a number of interest to a user, a cable for suspending the weight block connecting unit through a sheave supported by the ceiling of the weight frame, and a shock damper placed beneath the weight blocks. The shock damper damps shock and vibrations generated by the impact of lifted weight blocks returning against the remainder thereof to reduce impact noise while exercising. The machine further includes elastic members disposed on stoppers mounted beneath the lowermost of the weight blocks so as to support them. The elastic members absorb minor shock occurring when the lifted weight blocks fall on the remainder thereof or when all of the weight blocks are lifted and fall on the stoppers.

8 Claims, 13 Drawing Sheets

NOISE LEVEL WHERE 6 WEIGHT BLOCKS FALL FROM A HEIGHT OF 100(mm)

NOISE LEVEL WHERE 12 WEIGHT BLOCKS FALL FROM A HEIGHT OF 100 (mm)

WEIGHT TRAINING MACHINE

BACKGROUND OF THE INVENTION

The present invention relates generally to a weight training machine and more particularly to a noiseless weight training machine wherein noise induced by lifting weight blocks up and down is reduced.

Recently, there are an increasing number of people who shape up with a weight training machine. Many are training at exercise areas within a building for example. A typical weight training machine comprises a base frame mounted on a floor, a rectangular shaped weight frame installed on the base frame, a pair of parallel guiding rods extending vertically from the base frame, a plurality of weight blocks for traveling up and down along the guide rods, a weight block connecting unit for connecting a number of weight blocks of interest to the user, and a cable for suspending the weight block connecting unit through a sheave supported by a ceiling frame. The user lifts a selected number of weight blocks up and down with his arms or legs to train the upper or lower body.

However, in conventional weight training machines, lifting the weight blocks generates impact noise or vibrations due to the shock of the lifted weight blocks coming down against the remainder thereof or against the stoppers provided beneath the lowermost weight blocks for supporting them. The impact and vibration can damage the floor of a building and the impact noise is a source of noise pollution.

SUMMARY OF THE INVENTION

It is, accordingly, an object of the present invention to provide a noiseless weight training machine.

According to one aspect of the present invention, there is provided a weight training apparatus which comprises a weight, lifting means for lifting the weight up and down to provide a weight load to a user, and damping means for absorbing shock due to the falling of the weight lifted by the lifting means to reduce noise generated by the impact.

According to another aspect of the invention, there is provided a weight training apparatus which comprises a frame, a plurality of weight blocks provided so as to overlap each other in said frame, a guide rod, mounted in the frame, for guiding the weight blocks in traveling up and down, lifting means for lifting a selected number of weight blocks up and down along the guide rod to provide a weight load to a user, and damping means for absorbing shock due to the falling of the weight lifted by the lifting means to reduce noise generated by the impact.

In the preferred embodiment, an elastic member may be provided beneath the lowermost weight block of the plurality of weight blocks so as to support them. The elastic member absorbs shock caused by the falling of the weight blocks lifted by the lifting means. The lifting means may include a weight connecting unit for providing connection to a selected number of weight blocks for lifting. The weight blocks have a vertical hole therethrough so as to allow alignment with each other and also have a through hole in the sides thereof respectively. The weight connecting unit includes a connecting rod inserted through the holes of the weight blocks so as to partly project from the lowermost weight block. The connecting rod has a plurality of holes arranged so as to be aligned with corresponding through holes formed in the sides of the weight blocks. The weight connecting unit further includes a pin for insertion into one of the side holes and through the corresponding hole of the connecting rod to provide a selected weight load to a user. The damping means is preferably a shock damper which has a piston rod and is mounted beneath the lowermost weight block so as to align the piston rod with the bottom of the connecting rod. The piston rod comes in contact with the lower surface of said connecting rod before the lifted weight blocks come into contact with the remainder thereof to absorb the shock of the impact of the falling weight blocks.

BRIEF DESCRIPTION OF THE DRAWINGS

The present invention will be understood from the detailed description given hereinbelow and from the accompanying drawings of the preferred embodiment which are given for explanation and understanding only and are not intended to imply limitations to the invention.

DESCRIPTION OF THE PREFERRED EMBODIMENT

Figure 1:
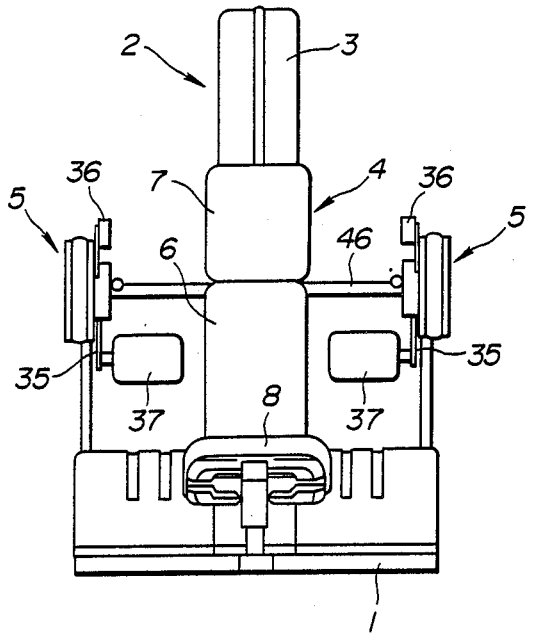
FIG. 1 is a front view which shows a weight training machine according to the present invention.
Figure 2:
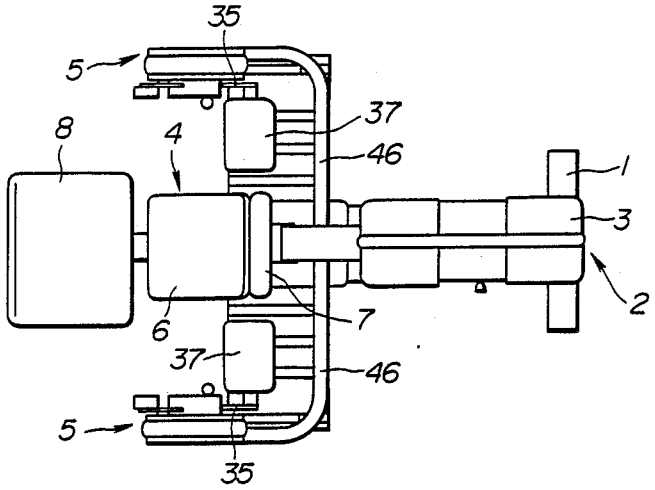
FIG. 2 is a plan view of a weight training machine shown in FIG. 1.
Figure 3:
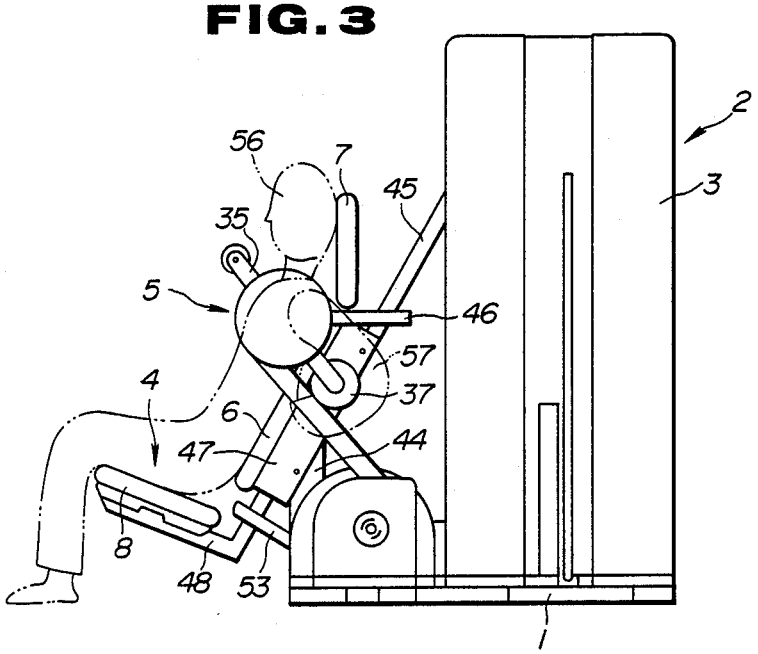
FIG. 3 is a side view of a weight training machine shown in FIG. 1.

Referring now to the drawings, particularly to FIGS. 1 to 3, there is illustrated a weight training machine according to the present invention. This machine comprises generally a base frame 1, a weight lifting portion 2 covered by a resin cover 3, a seat portion 4, and a swing arm portion 5. The machine is adapted such that a user sits down on a chair and hangs both arms over the swing arms of the machine. A swinging action causes the weight blocks to be lifted up and down to provide exercise for hardening the muscles of the upper body.

Figure 4:
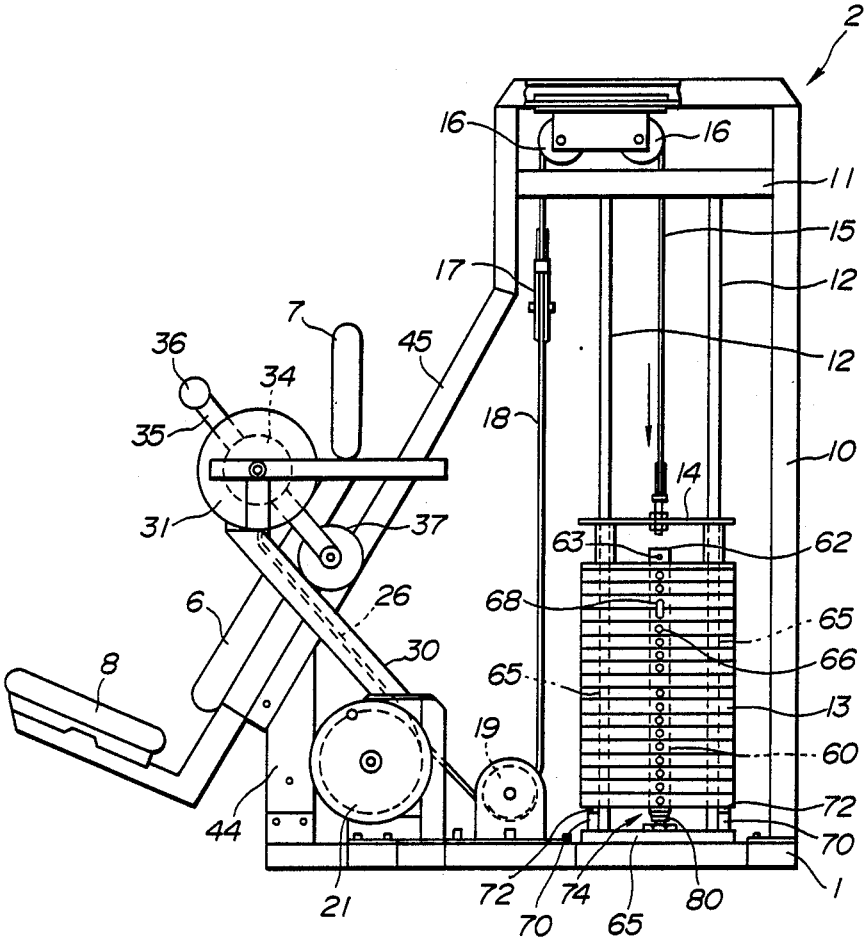
FIG. 4 is a side view which shows a weight training machine excluding the cover thereof.

Referring to FIG. 4, the weight lifting portion 2 includes a weight frame 10 secured to the base frame 1, a plurality of weight blocks 13 overlapping each other, a pair of guide rods 12, and a sheave assembly 16 for the weight blocks. The sheave assembly 16 is suspended from the ceiling of the weight frame 10. The guide rods are inserted through holes 65 provided in both sides of each weight block and are vertically arranged on the base frame 1 parallel to each other. The weight blocks 13 are made of metal plate having a predetermined weight and there is another hole 60 through the center of each. A weight connecting unit 14 is provided which includes a rod 62 inserted through the holes 60 of the weight blocks. The rod 62 is connected to the weight unit 14 by means of a pin 63. The rod 62 has a plurality of through holes 64 which are spaced from each other by a distance corresponding to the thickness of a weight block to align with holes 66 formed in the sides of the weight blocks 13. Insertion of a pin 68 into the hole 66 of one of the weight blocks 13 and through the corresponding hole 64 in the rod 62 provides weight blocks of a number of interest to the user. The weight connecting unit is lifted up and down along the guide rods 12 with the selected number of weight blocks according to rotation of the cam sheave 21, controlled by the swinging motion of the users arms. The lower end of the rod 62 projects downward through the lowermost weight block. Stoppers 70 are disposed on both sides of a base plate 65 seated on the base frame 1 respectively so as to support the weight blocks.

Figure 5:
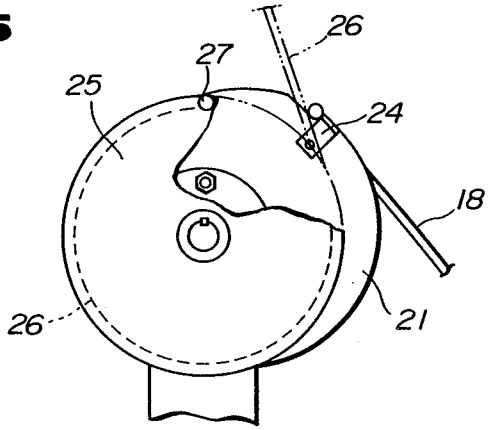
FIG. 5 is a side view which shows a sheave arrangement of a weight training machine.
Figure 6:
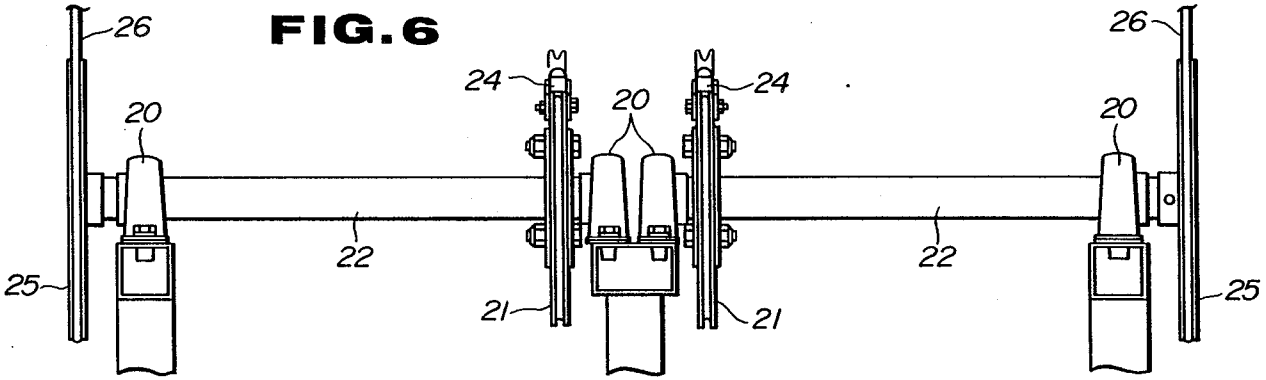
FIG. 6 is a plan view of a sheave arrangement shown in FIG. 5.
Figure 7:
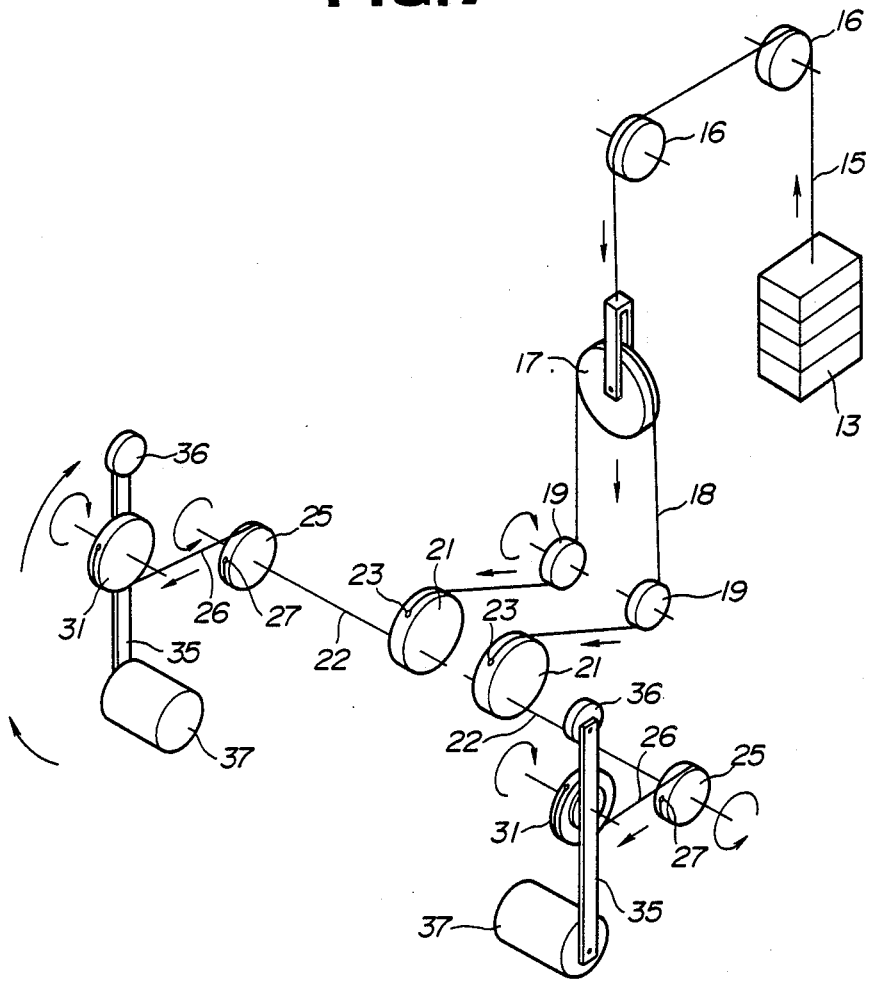
FIG. 7 is a view which shows a weight load transfer system.

The weight blocks are, as can be seen in FIG. 7, connected to a pair of cam sheaves 21 via the weight connecting unit 14 and cables 15 and 18. The swing of the users arms causes the cam sheaves 21 to rotate thereby lifting the weight blocks up and down as described above. Each cam sheave 21 is, as shown in FIGS. 5 and 6, connected eccentrically to a cam shaft 22 which is rotatably supported by bearing units 20. The bearing units are installed on the base frame 1 so that the two cam sheaves are arranged parallel to each other. Each cable 18 is connected to the circumference of the cam sheave by means of a fastener 24. Installed on the outer end of each cam shaft 22 is another sheave 25. An end of each cable 26 is connected to the circumference of the sheaves 25 by a fastener 27 and wound therearound by about one cycle and extending through a hollow stay 30 (as shown in FIG. 4) toward an additional sheave 31 which is pivotably supported above the stay. The other end of the cable 26 is wound around the sheave 31 by one cycle and is connected thereto.

Figure 9:
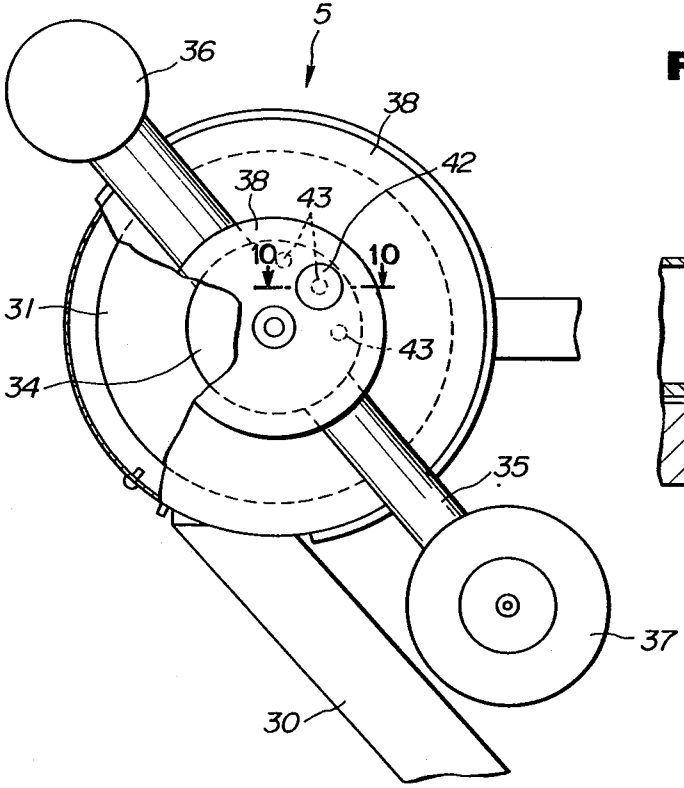
FIG. 9 is a fragmentary sectional side view of FIG. 8.
Figure 8:
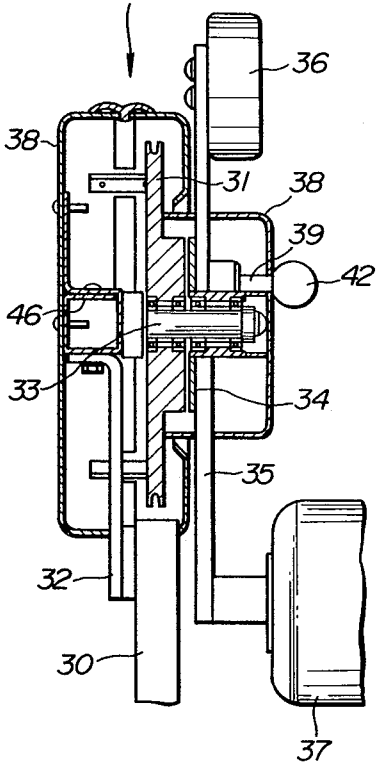
FIG. 8 is a fragmentary sectional view which shows a swing arm portion of a weight training machine.

Referring to FIGS. 8 and 9, the swing arm portion 5 includes a swing arm 35 having an arm pad 37 and a sheave 31 for rotating along with the swing arm to lift the weight blocks up and down via the cables. The sheave 31 is rotatably supported by a shaft 33 fixed on a mounting member 32 through radial bearings. The mounting member is supported on the upper end of the stay 30. A rotary disk 34 is also supported by the shaft 33 and attached to the swing arm 35. Secured on an end of the swing arm is a counter weight 36, while the arm pad 37 is perpendicularly installed on the other end thereof so as to extend inwardly. A cover 38 is provided for the rotary disk 34 and the sheave 31.

Figure 10:
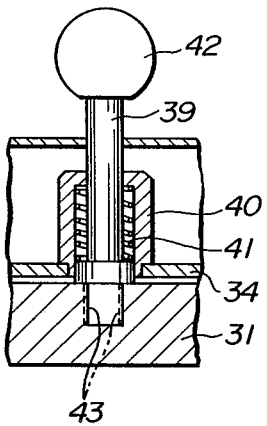
FIG. 10 is a sectional view along line 10—10 of FIG. 9 which shows a clutch for the swing arm portion.

The swing arm portion further includes a clutch for engaging the rotary disc 34 and the sheave 31. This clutch is, as shown in FIG. 10, comprised of a lever 39, a knob 42, a coil spring 41, and a clutch housing 40 secured on the rotary disk 34. The coil spring urges the lever 39 so that its end is inserted into one of bores 43 formed in the sheave 31 at a predetermined space. The user pulls the knob 42 out and inserts the lever 39 into a selected one of bores 43 to determine a suitable angular position, for the swing arm 35 with respect to the sheave 31.

Figure 11A:
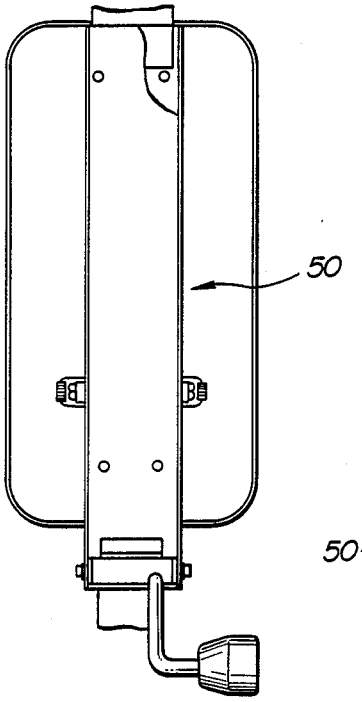
FIGS. 11A and 11B are views of a seat of a weight training machine which is adjustable as to its height from the floor.
Figure 11B:
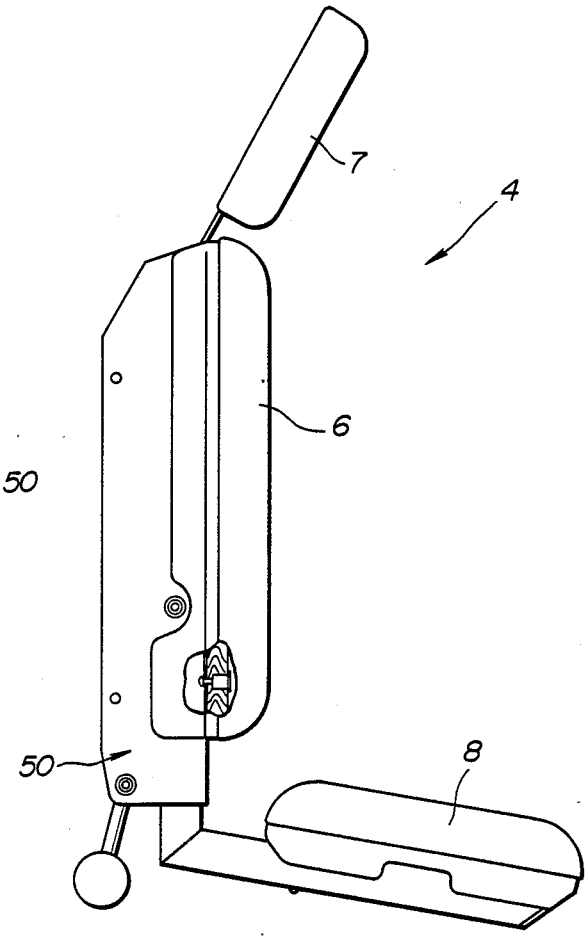
Figure 12:
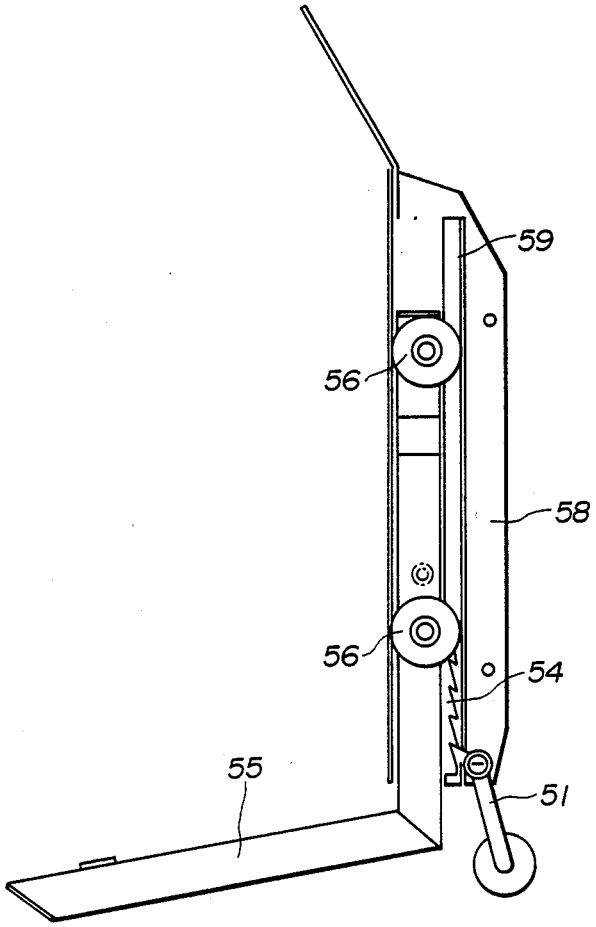
FIG. 12 is a sectional side view of a seat as shown in FIG. 11.

Referring to FIGS. 11 and 12, the seat portion 4 is shown. This seat portion includes a head rest 7, a seat back 6, a seat 8, and a seat adjuster 50 for adjusting the height of the seat 8 from the floor to suit the users sitting height. The seat adjuster includes a frame 58, a seat support member 55, rollers 56, a rack 54, and a hand lever 51. The rollers 56 are rotatably supported on the upper and lower side of the seat support member. The seat support member 55 is adapted for sliding vertically along a guide rail provided in the frame 58. At the lower back side of the support member 55, a rack 54 for engaging with the hand lever 51 is attached. A slight lifting of the seat support member and the rotation of the hand lever causes the engagement of the hand lever with the rack to be released. The user adjusts height of the seat support member and engages the hand lever with the rack again to provide a seat position comfortable to the user.

Figure 13:
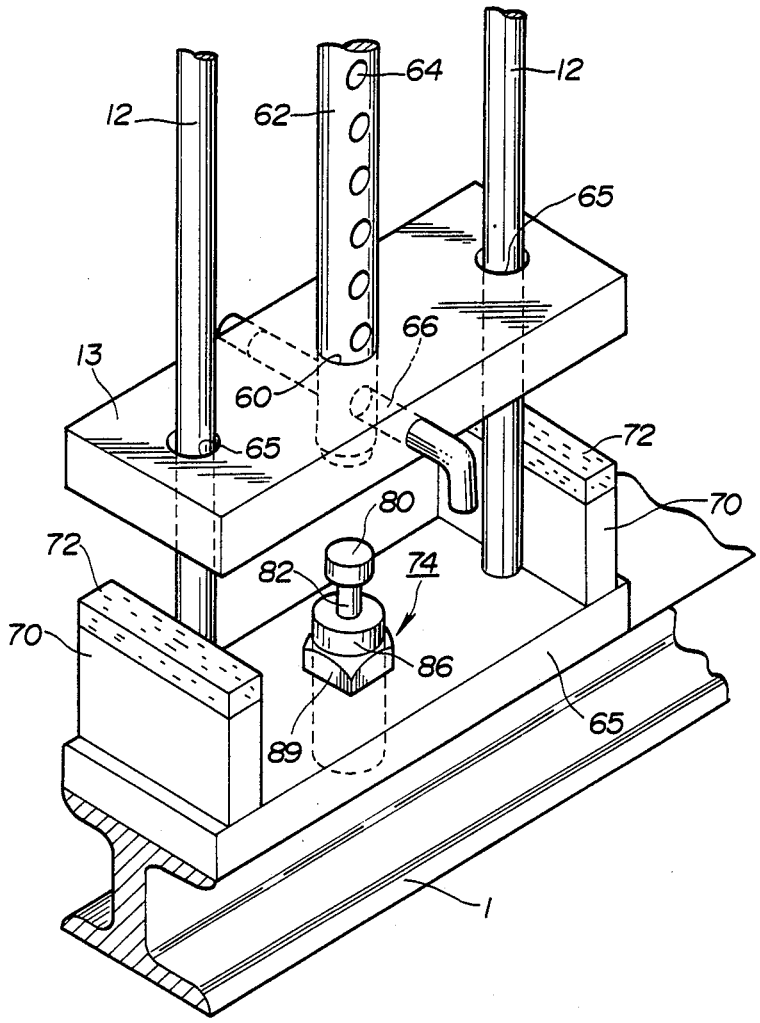
FIG. 13 is a partially sectional perspective view which shows a shock damper arrangement according to the invention.

Referring to FIG. 13, the weight lifting portion 2, as shown in FIG. 4, further includes elastic members 72 such as rubber blocks or stops, and a shock damper 74. The elastic members are placed on the stoppers 70 and the damper is mounted in the base plate 65 between the stoppers by means of a nut 89 so as to be aligned with the bottom of the connecting rod 62. The shock damper 74 is adapted for damping a main shock due to the falling of the weight blocks during exercise with the result that noise generated by the impact is reduced. The elastic members absorb minor shock occurring when lifted weight blocks come in contact with the remainder thereof after the main shock is absorbed by the shock damper. The elastic members also absorb shock when all weight blocks are lifted up and fall back on the stoppers. The lowermost weight block may therefore be seated on the stoppers quietly via the elastic members.

Figure 14:
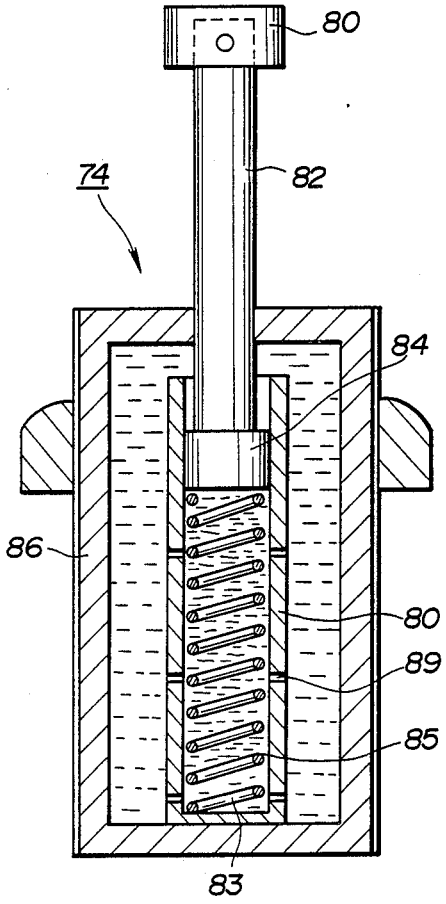
FIG. 14 is a sectional view of a shock damper according to the invention.

Referring to FIG. 14, the shock damper 74 is shown. This damper comprises a casing 86, a hollow cylinder 88, a coil spring 83, a piston 84, a piston rod 82, and a piston cap 80. The piston cap 80 is rotatably supported over the upper end of the piston rod 82 so that the entire upper surface of the piston cap comes in contact with the bottom surface of the rod 64 so as to absorb the shock efficiently when the weight blocks come down. The coil spring is disposed within the cylinder so as to urge the piston upwardly. The casing is filled with a working fluid 85. A plurality of orifices are provided in the cylinder.

The principle of operation of the shock damper is such that impact to the piston cap 80 causes the piston 84 to press the working fluid 85 against the spring force, the fluid thereby gushing through the orifices. The loss of dynamic pressure resistance occurring at the point of gushing converts all shock energy into thermal energy. This thermal energy radiates naturally to atmosphere from the outer surface of the casing of the shock damper to absorb the shock energy efficiently. Thus, no reaction occurs at the end stroke of the piston rod. After the piston moves down, the coil spring 83 returns the piston 84 to its initial position and the working fluid flows into the cylinder through the orifices again. It will be understood that noise which is generated due to the contact of the lifted weight block(s) with the remainder thereof during exercising is reduced extremely.

A user 56 beginning to exercise with the weight training machine, as shown in FIG. 3, is seated on the chair of the machine and then leans against the backrest 6 and places his/her head on the head rest 7. With arms 57 firmly against the arm pads 37 the user swings them vertically with respect to the shoulders either simultaneously or alternately.

The vertical movement of the users arms causes the swing arms 35 to swing in the same direction. The rotary disks 34 also rotate together with the sheaves 31 to wind the cables 26 thereon. The sheaves 25 rotate in a reverse direction to the sheaves 31 due to the pulling force of the cables 26 and the cam sheaves 21 rotate in this same direction via the shaft 22. The rotation of the cam sheaves 21 causes the cables to be wound thereon, the running sheave 17 thereby falling. The predetermined number of weight blocks 13 are simultaneously lifted up to provide weight load to the arms of the user.

When the user swings one of his arms, one of the cables 18 is pulled. A displacement of the running sheave 17 to a degree 'n' requires an angular displacement of the swing arm 35 of twice that degree (2 n).

When the lifted weight blocks 13 fall down, the projecting lower end of the rod 62 comes in contact with the piston cap 80 before the lowermost block of the lifted blocks which are supported on the rod 62 via the pin 68 come in contact with the uppermost of the remaining weight blocks. The fall of the weight blocks is slowed by the shock damper according to the principle of operation described above and come in contact with the the uppermost of the remaining weight blocks quietly. It will be noted that the main shock caused by the fall of the lifted weight blocks is absorbed completely. During exercise, when the weight blocks are again lifted, the piston rod 82 of the damper projects upward due to spring force of the coil spring 83.

Figure 15:
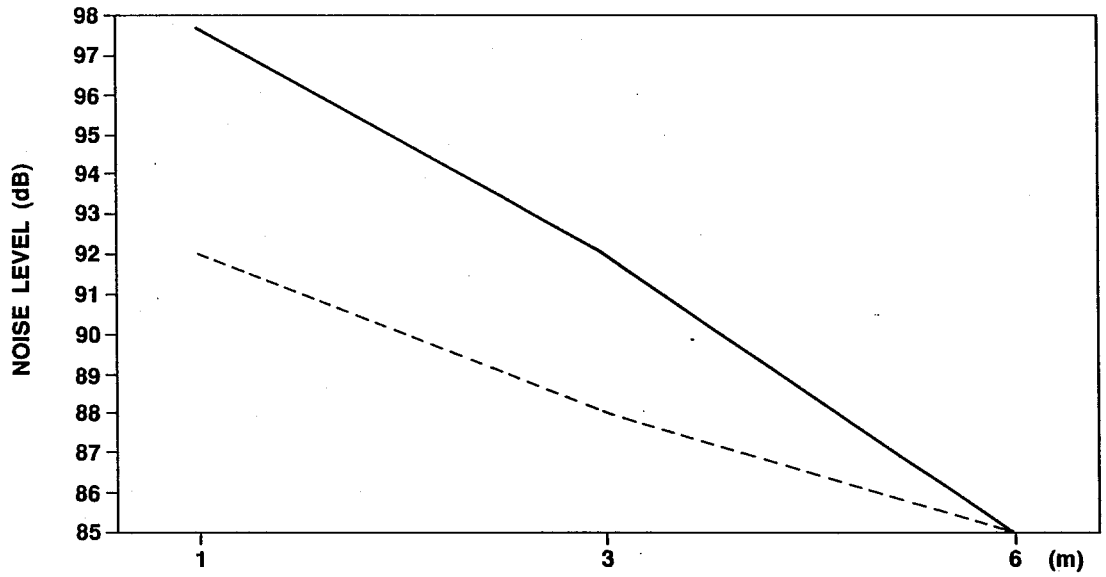
FIG. 15 is a graph which shows the noise level where six weight blocks fall from a height of 100 (mm).
Figure 16:
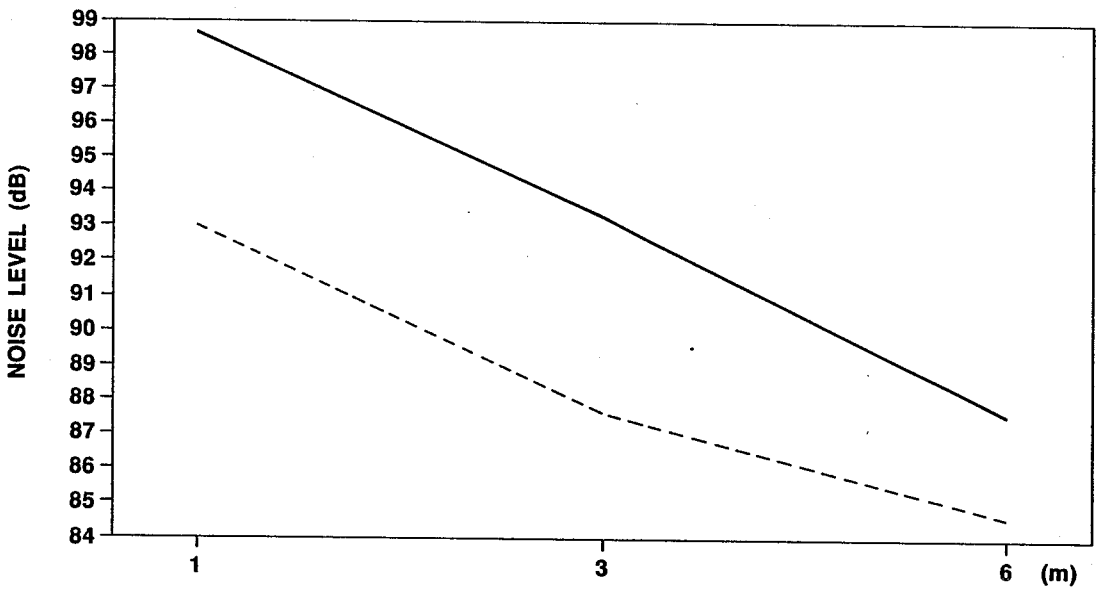
FIG. 16 is a graph which shows the noise level where twelve weight blocks fall from a height of 100 (mm).

FIGS. 15 and 16 show the noise levels induced by the lifting of the weight blocks on a conventional type weight training machine, and on a weight training machine with a shock damper according to the invention, as measured in a gymnasium. The ordinate axis designates a noise level (dB), while the axis of abscissa designates a distance (m) of a noise level meter from the test machine. The solid line indicates the noise level of the conventional weight training machine and the dotted line indicates the noise level of the machine according to the invention.

FIG. 15 shows the noise level when six weight blocks fall from a height of 100 (mm). It will be understood that the noise reduction is greatly effected by the shock damper according to the invention, especially when relatively close to the test machine.

FIG. 16 shows the noise level when twelve weight blocks fall from a height of 100 (mm). It will be understood that noise reduction is effected by the shock damper even at locations relatively far from the test machine.

Figure 17:
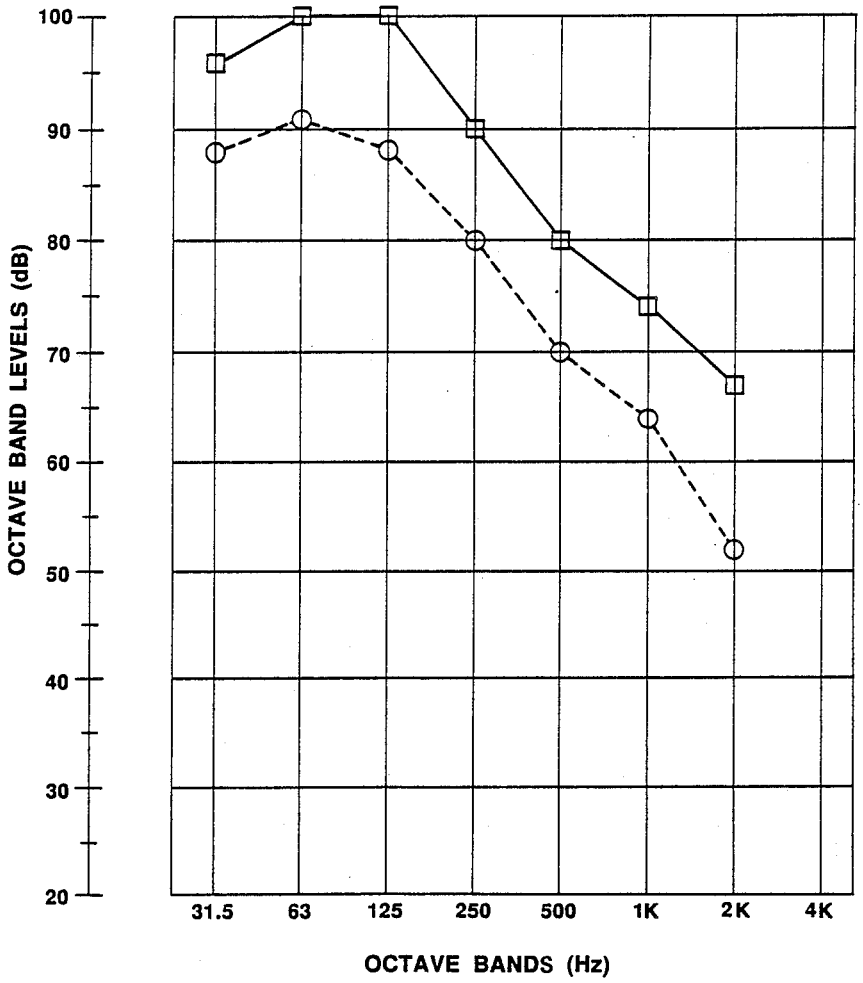
FIG. 17 is a graph which shows the noise level at relevant octave bands where weight blocks having a weight of 60 (kg) fall freely from a height 450 (mm).

FIG. 17 shows the noise level with respect to octave bands. The ordinate axis designates octave band levels (dB) (noise levels), while the axis of abscissa designates the center frequency of the octave bands. The solid line indicates the noise level of the conventional weight training machine excluding a shock damper and the dotted line indicates the noise level of the machine of the invention. For the measurement, the respective weight training machines were mounted on an concrete slab on the second floor of a gymnasium. A set of weight blocks having a weight of 60 (kg) were allowed to fall freely from a height of 450 (mm), the noise levels were measured on the first floor just beneath the respective weight training machines. The following table shows the test results indicated by FIG. 17.

TABLE

| | Frequency (Hz) | | | | | | |
|---|---|---|---|---|---|---|---|
| | 31.5 | 63 | 125 | 250 | 500 | 1K | 2K |
| C | 96 | 100 | 100 | 90 | 80 | 74 | 66 |
| I | 88 | 91 | 88 | 80 | 70 | 64 | 52 |
| | | | | | | | (dB) |

I: Weight training machine of the invention
C: Conventional type weight training machine It will be noted that the weight training machine according to the invention can reduce noise levels effectively at each octave band.

Therefore, in a weight machine according to the invention, vibration and noise which are generated by the impact of lifted weight blocks falling against the remainder thereof, or impact noise against the stoppers due to the lifting of all the weight blocks up and down is absorbed by the shock damper to be reduced effectively. Thus, noise pollution is prevented.

Although the invention has been shown and described with respect to a best mode of embodiment thereof, it should be understood by those skilled in the art that the foregoing and various other changes, omissions, and additions of the form and detail thereof may be made therein without departing from the spirit and scope of the invention.

What is claimed is:

1. A weight training apparatus comprising:

a weight means provided with a plurality of weight blocks overlapping each other, said weight blocks having a through hole so as to allow alignment with each other;

lifting means for lifting said weight blocks up and down to provide a weight load to a user, said lifting means including a connecting unit which has a connecting rod inserted through the through holes in said weight blocks so as to partly project from the lowermost weight block for connecting a number of weight blocks of interest to the user to provide a selected weight load to the user; and damping means operative to absorb down force caused by falling of the lifted weight blocks through the connecting rod before the lifted weight blocks come into contact with the remainder thereof to reduce noise generated by the impact.

2. An apparatus as set forth in claim 1, further comprising an elastic member disposed beneath the lowermost weight block so as to support it, said elastic member absorbing shock caused by the falling of the weight block lifted by said lifting means.

3. An apparatus as set forth in claim 1, wherein said weight blocks have a through hole in the sides thereof respectively, said connecting rod having a plurality of holes arranged so as to be aligned with corresponding through holes formed in the sides of said weight blocks, said weight connecting unit further including a pin for insertion into one of said side through holes and through the corresponding hole of the connecting rod to provide a selected weight load to the user.

4. An apparatus as set forth in claim 3, wherein said damping means is a shock damper having a piston rod which is mounted beneath the lowermost weight block so as to align the piston rod with the bottom of said connecting rod, said piston rod coming in contact with the lower surface of said connecting rod before the lifted weight blocks come into contact with the remainder thereof to absorb the shock of the impact of the falling weight blocks.

5. An apparatus according to claim 1 wherein said damping means is a single damping means operative to absorb down force.

6. A weight training apparatus comprising:

a frame;

a plurality of weight blocks provided so as to overlap each other in said frame, said weight blocks having a center through hole so as to allow alignment with each other and also having a through hole in the sides thereof respectively;

a guide rod, mounted in said frame, for guiding said weight blocks in traveling up and down;

lifting means for lifting a selected number of weight blocks up and down along said guide rod to provide a weight load to a user, said lifting means including a connecting unit which has a connecting rod inserted through the holes of said weight blocks so as to partly project from the lowermost weight block, said connecting rod having a plurality of holes corresponding to those formed in the sides of said weight blocks, said weight connecting unit further including a pin for insertion into one of said side through holes and through the corresponding hole of the connecting rod to provide a selected weight load to a user; and damping means for absorbing shock due to the falling of the weight block lifted by said lifting means to reduce noise generated by the impact, said damping means including a shock damper which has a piston rod mounted beneath the lowermost weight block so as to align the piston rod with the bottom of said connecting rod, said piston rod coming in contact with the lower surface of said connecting rod before the lifted weight blocks come into contact with the remainder thereof to absorb the shock of the impact of the falling weight blocks.

7. An apparatus as set forth in claim 6, further comprising an elastic member disposed beneath the lowermost weight block of said plurality of weight blocks so as to support them, said elastic member absorbing shock due to contact of falling weight blocks with the remainder thereof.

8. An apparatus according to claim 6 wherein said damping means is a single damping means for absorbing shock.

* * * * *